United States Patent [19]

Schmidt

[11] 4,346,329

[45] Aug. 24, 1982

[54] AIMING POST LIGHT

[76] Inventor: Robert C. H. Schmidt, 16001 Tonkawood Ct., Minnetonka, Minn. 55343

[21] Appl. No.: 191,182

[22] Filed: Sep. 26, 1980

Related U.S. Application Data

[62] Division of Ser. No. 69,954, Aug. 27, 1979, Pat. No. 4,290,095.

[51] Int. Cl.[3] ..... H01J 7/44; H01J 17/34; H01J 19/78; H01J 29/96; H01K 1/62

[52] U.S. Cl. ..... 315/51; 313/498; 315/71; 250/552; 362/800; 362/191

[58] Field of Search ..... 315/51, 71, 64, 65, 315/135; 313/512, 498, 499; 250/551, 552; 362/191, 197, 800

[56] References Cited

U.S. PATENT DOCUMENTS

| | | | |
|---|---|---|---|
| 3,581,162 | 5/1971 | Wheatley | 250/552 X |
| 3,732,560 | 5/1963 | Harden et al. | 362/800 |
| 3,771,031 | 11/1973 | Kay | 313/499 |
| 3,795,830 | 3/1974 | Richardson | 313/512 |
| 3,869,641 | 3/1975 | Goldberg | 313/512 |
| 4,170,036 | 10/1979 | Sussel | 362/800 |
| 4,211,955 | 7/1980 | Ray | 313/512 |
| 4,228,485 | 10/1980 | Hubbard et al. | 362/191 |
| 4,308,572 | 12/1981 | Davidson et al. | 362/800 |

*Primary Examiner*—Saxfield Chatmon, Jr.
*Attorney, Agent, or Firm*—Nathan Edelberg; Robert P. Gibson; Robert O. Richardson

[57] ABSTRACT

An aiming post light for artillery and mortar operations at night wherein an ordinary GI flashlight may be used, without modification, as a post light when mounted on a support and wherein its original ordinary lightbulb is replaced with a novel bulb of same base outer configuration in which the bulb has encapsulated solid state circuitry to provide a blinking and/or steady light emitting diode (LED) as the light source. Depending upon the particular LED and circuitry selected, the light may be continuous or intermittent and may be a selected color. In one embodiment several options are available when using a single bulb.

4 Claims, 6 Drawing Figures

FIG__3__
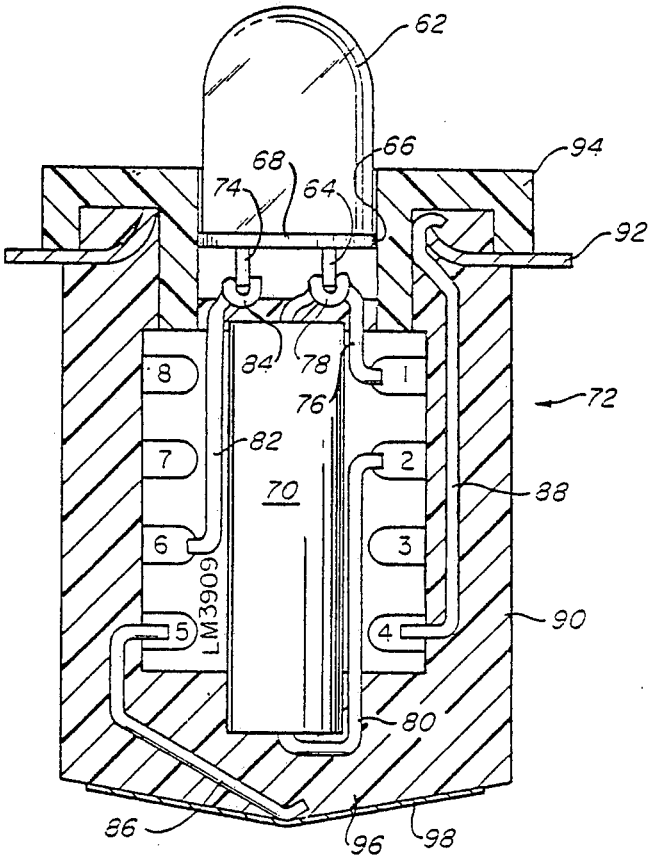
FIG__4__
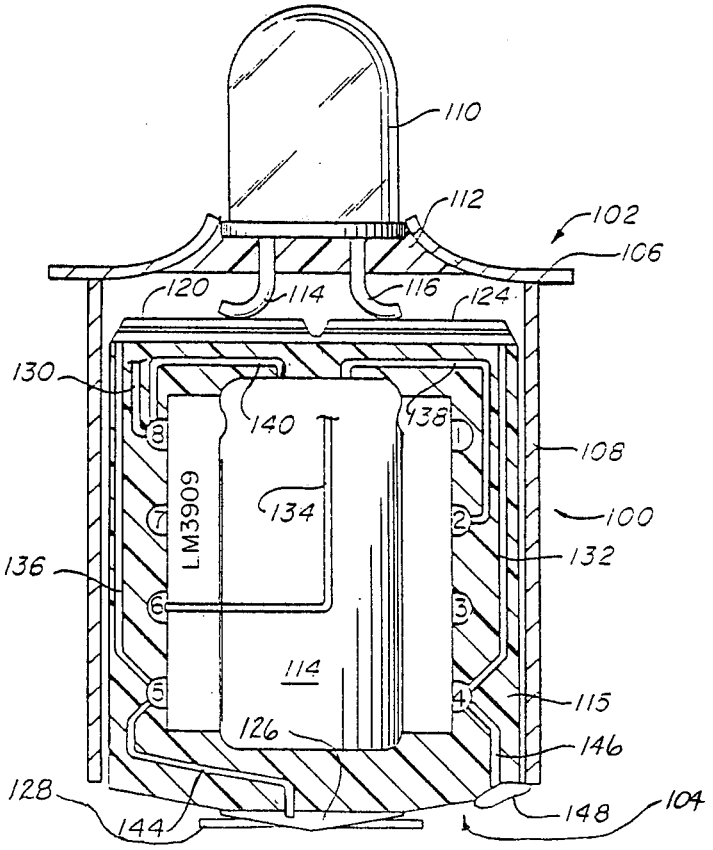

AIMING POST LIGHT

GOVERNMENT RIGHTS

The invention described herein may be manufactured and/or used by or for the Government for governmental purposes without the payment of any royalty thereon.

RELATED INVENTIONS

This application is a divisional application of Ser. No. 069,954 filed Aug. 27, 1979, now U.S. Pat. No. 4,290,095, by Robert C. H. Schmidt for a Aiming Post Light.

BACKGROUND OF THE INVENTION

Since WWII the M14 Aiming Post Light has been used for artillery and mortar operations to maintain orientation despite possible movement of the gun when fired. Each light consisted of two size D flashlight batteries in a brass case having an on-off switch, an incandescent bulb and a reflector/lens filter. To avoid confusion, half the lights have a red filter and half have a green filter. Each howitzer or mortar uses one of each. They presently cost over $25 each.

Aiming post lights are placed forward of their guns a distance from 50 to 100 meters. They drain the batteries in a night or so and require replacement, sometimes a hazardous task, particularly when the enemy is close by. Obviously an aiming light that will survive an engagement without replacing batteries is preferred.

The aiming post light in the Hubbard et al application consisted of a flashlight with a LED and integrated circuitry that had to be attached to the flashlight contacts with clips, which was unacceptable from a ruggedness viewpoint, or soldered to the contacts, which made it nonreversible back to flashlight use again. FIG. 3 of Hubbard et al. overcomes this with a bulb having a capacitor 52 as the base and an integrated circuit 56 on the bottom. This posed fabrication problems.

SUMMARY OF THE PRESENT INVENTION

In accordance with the present invention, an aiming post light has been developed that has a very prolonged use life compared to those heretofore used. Advantage is taken of solid state circuitry, including solid state light sources, which will provide an appropriate light intensity and switching frequency to obtain most efficient use of dry cell energy while obtaining optimum human perception of the light.

In a preferred embodiment, a GI flashlight is fitted with a stake engaging clamp. The head of the flashlight has a pair of contacts which contact the bottom of the regular flashlight bulb and the side of the reflector into which the bulb is positioned. These contacts place the bulb into the circuit with the batteries and on-off switch for its operation. In the present invention, the solid state circuit, including the light emitting diode, is formed into a flashlight bulb configuration and is positioned in the reflector to replace the original flashlight bulb. The regular flashlight on-off switch is thus in circuit and is used to initate the blinking action of the diode. The diodes may emit red or green light and the blinking frequencies of each color may vary to assist color blind operators to distinguish between the two colors.

Not only does the blinker aiming post light of the present invention achieve its major goal of extremely long use life, in the order of months instead of hours, but it is also far less expensive than those heretofore used. For example, the flashlight costs about $2.13 and the novel bulb less than $1. Flashlights and batteries are already fielded items, plentiful in supply and easy to obtain. Only the mounting bracket and light bulb need be added.

The present invention is an improvement over the copending Hubbard et al invention previously referred to in that the novel light bulb is in various forms of fabrication and certain embodiments provide for several modes of operation, i.e., continuous or blinking light and selected colors from the same bulb. Additionally, a mounting bracket has been designed for use with the flashlight belt clip so that no modification of the flashlight is necessary.

BRIEF DESCRIPTION OF DRAWINGS

FIG. 3 is a sectional view of a second form of bulb, FIG. 4 is a sectional view of a third form of bulb.

DETAILED DESCRIPTION OF ILLUSTRATIVE EMBODIMENTS

Figure 1:
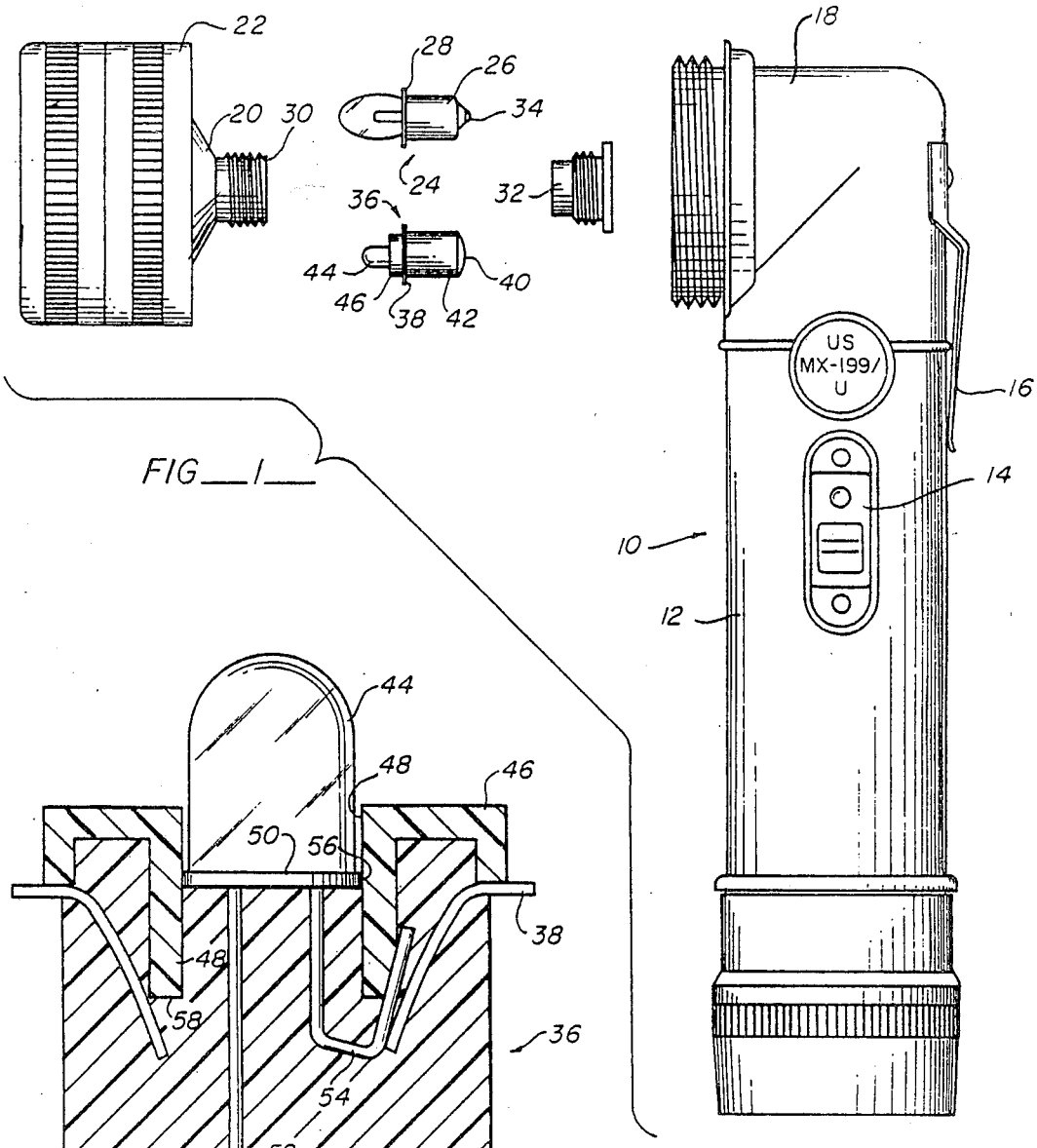
FIG. 1 is a perspective view of an ordinary GI flashlight with bulb holder removed, and showing an ordinary flashlight bulb and a bulb made in accordance with the present invention.

Reference is now made to FIG. 1 wherein there is shown a conventional GI flashlight 10 having a body portion 12 containing a pair of size D 1.5 volt dry cell batteries, not shown. On the side is a switch 14 and on the back is a belt clip 16. The head 18 of the body portion extends normal to the axis of the body portion to enable a beam of light to be directed horizontally when the body portion is in upright position. A reflector 20 and lens, not shown, is positioned within a lens holder 22. A conventional light bulb 24 has a metallic base 26 and collar 28 that fits into the center threaded opening 30 of the reflector and is held in place with a plastic bulb holder 32. When assembled, the metallic base 26, collar 28 and reflector 20 makes electrical contact with a negative lead, not shown, on the inner side of head 18. The center contact 34 of the bulb contacts a positive lead, not shown, in the center of the head 18.

In accordance with the present invention bulb 36 replaces the conventional bulb 24. This new bulb is of the same general configuration as bulb 24 so that it is interchangeable without requiring modification of the flashlight. It has a metallic collar 38 and a center contact 40 which make the same electrical contacts as collar 28 and contact 34 of bulb 24. The base 42 is potted plastic. A light emitting diode (LED) 44 is positioned on the end where it is retained by a plastic grommet 46.

Figure 2:
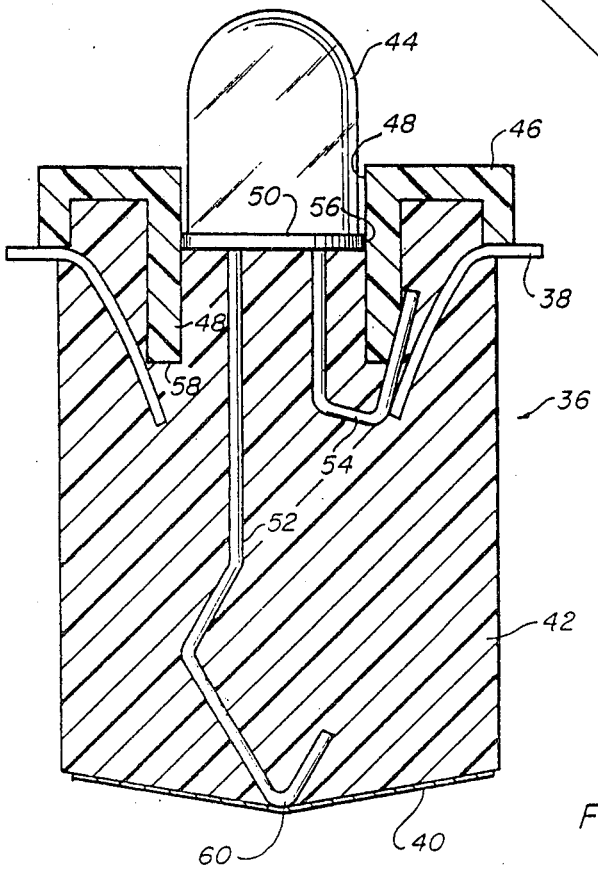
FIG. 2 is a sectional view of a first form of bulb.

A sectional view of the bulb 36 is shown in FIG. 2. Here the LED 44 is positioned within the center opening 48 of plastic grommet 46. This opening has a cylindrical wall against which the LED base 50 sets. This base includes integrated circuitry which will cause the LED to flash at a rate of approximately 3 times per second. Extending downwardly are leads 52, 54. Lead 54 is the cathode or negative lead and is identified as such by a flat edge 56 on base 50 in close proximity to the lead. The LED 44 will not operate if the leads are accidentally reversed.

A brass grommet or collar 38 is positioned over the inner end 58 of cylindrical wall 48 and in electrical contact with cathode lead 54. This grommet flares outwardly and will make contact with reflector 20 of the flashlight shown in FIG. 1, when inserted therein.

The anode or positive lead 52 extends downwardly through the center of the epoxy plastic base 42 and makes electrical contact with an aluminum conductive foil or center contact 40 on the end of the base 42. Wall 48 of plastic grommet 46 keeps this lead 52 spaced from brass grommet 38 until plastic base 42 has been formed.

LED 44 preferably is a commercially available flasher unit known as Flashing Red Light (FRL) 4403 made by Litronix, 19000 Homestead Rd., Valico Park, Cupertino, Calif. 95014 and marketed by Radio Shack, a Division of Tandy Corporation, 1500 One Tandy Center, Fort Worth, Tex. 76102. The FRL-4403 is a gallium arsenide phosphide solid state lamp with a red diffused plastic lens. The built-in integrated circuit flashes the lamp and can be driven directly by standard digital logic chips having transister-transister logic (TTL) or complimentary metal oxide semiconductor (CMOS) circuits, eliminating the need for external switching circuitry. In the alternative, circuits shown and described in copending application Ser. No. 010,551 filed Feb. 9, 1979, now U.S. Pat. No. 4,228,485, for Blinker Aiming Post Light may be used. The LED 44 maximum supply voltage is 5.25 volts and operates between −55° C. and +55° C. Its peak emission wavelength is 650 mm and its supply current at 5 volts is typically 20 mA. The pulse rate typically is 3 Hz.

In making bulb 36 a preferred method involves the following steps:

1. Insert the LED 44 into the plastic grommet 46.
2. Bend and trim the cathode lead 54 to the approximate size and shape shown.
3. Insert the plastic grommet 46 and LED 44 into the brass grommet 38 with the cathode lead 54 between the two grommets.
4. Bend the anode lead 52 to the shape and length as shown, with the length between the collar of brass grommet 38 and the far bend 60 of anode lead 52 being the same length of the base of a standard flashlight bulb such as a PR6 for example.
5. Place a cylindrical mold around the brass grommet 38 and leads 52, 54, and fill with a non-conductive plastic such as epoxy.
6. When the epoxy has set, remove the mold, trim the end to shape, exposing the anode lead bend 60.
7. Affix a conductive disc such as aluminum foil to the base and assemble into flashlight to obtain diode flashes to ensure electrical integrity.

Reference is now made to FIG. 3 which shows in section a second embodiment light bulb which uses a Tri-Color LED 62 identified as Radio Shack catalog part no. 276-035. This LED has internal circuitry including a pair of diodes (one red, one green) in series in a push-pull arrangement whereby a current flow in one direction lights the green diode and a current flow in the other direction lights the red diode. An alternating current lights both diodes for a yellow color effect. If cathode lead 64, adjacent flat edge 66 on LED base 68, is connected to the negative side of a battery, a green light is emitted. If it is connected to the positive side of a battery, a red light is emitted. In the absence of additional circuitry such as Radio Shack integrated circuit LM 3909 (catalog part no. 276-1705) and condenser 70 (120 microfarads, 10 volts), the light emission would be steady. With this circuitry, the emission would be flashing. Hence, with flashlight batteries, this bulb may operate in any of four modes, red or green, steady or flashing.

In making bulb 72 in FIG. 3 which emits red or green flashing lights a preferred method involves the following steps:

1. Trim the leads 64, 74 on Tri-Color LED 62, as shown, to form prongs.
2. Bend condenser lead 76 to form a socket 78 for prong 64 and then attach lead 76 to pin 1 of integrated circuit LM 3909 for fast blinking rate or pin 8 for slower rate.
3. Bend the other condenser lead 80 as shown and attach to pin 2.
4. Bend wire lead 82 to form socket 84 for prong 74 and attach other end to pin 6.
5. Bend wire lead 86 as shown and attach to pin 5.
6. Attach lead 88 to pin 4 and extend upwardly until final assembly.
7. Place assembly in cylindrical mold and fill cavity with epoxy 90.
8. Place brass grommet 92 over top of epoxy with lead 88 extending through grommet opening.
9. Bend lead 88 over brass grommet 92 then insert plastic grommet 94 and Tri-Color LED 62 with prongs 64, 74 into sockets 78, 84. (Rotate the LED to change the light color.)
10. When set, remove from mold, shape base 96 and cap with contact 98 making contact with lead 86.

As previously stated, a bulb constructed as just described will emit flashing light only. However, it is a simple matter to change the bulb from green flashing operation to red flashing operation or vice versa. To do so, simply remove Tri-Color LED 62 from plastic grommet 94, rotate the LED 62 180 degrees and reinsert the LED 62 into the plastic grommet 94. Prong 64 of the Tri-Color LED 62 is now received in socket 84 and prong 74 is received in socket 78. The internal circuitry of the Tri-Color LED 62 will sense the polarity reversal and automatically cause the opposite color to light as previously described.

A four option LED module 100 is shown in section in FIG. 4. In this embodiment a simple switch is incorporated in the circuit to bypass the flashing circuitry. Thus, a single module provides for selected use of flashing red, flashing green, steady red or steady green light. Module 100 consists of two major parts, a brass cup 102 and an insert 104. Cup 102 consists of a brass grommet 106 attached to a brass cylinder 108. A Tri-Color LED 110 of the type used in FIG. 3 is bonded by epoxy 112 in the grommet opening. The LED leads 114 and 116 are trimmed and bent, as shown, to make contact with the top of insert 104.

Figure 5:
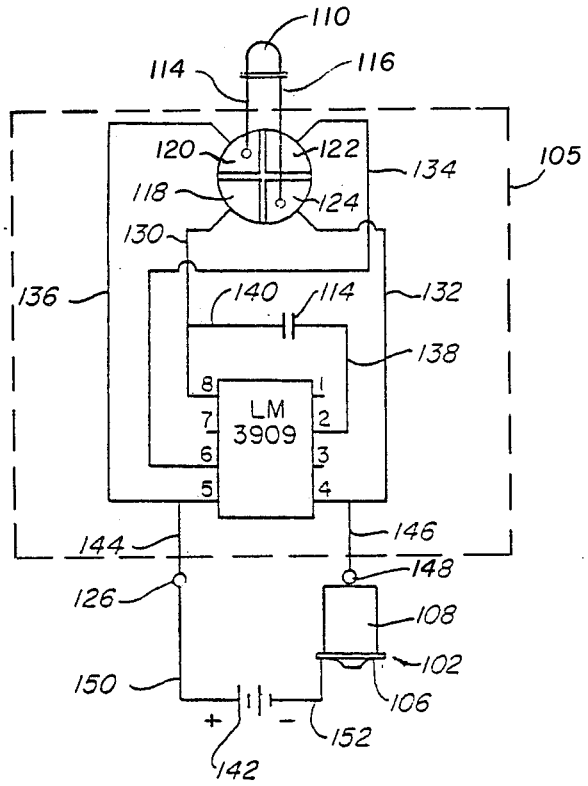
FIG. 5 is a schematic illustration of the circuitry involved with the bulb in FIG. 4.

The insert 104 consists of the integrated circuit LM 3909 of the type used in FIG. 3 and a 100 microfarad 10 volt capacitor 114 embedded in an epoxy material 115. Four conductive segments 118, 120, 122 and 124 (segments 118 and 122 not shown) are mounted on the top and a positive contact 126 with rotatable handle 128 on the bottom. Various leads interconnect various components as shown in FIG. 5. Here conductive segment 118 (not shown) is connected by lead 130 to pin 8 of LM 3909 (Connecting it to pin 1 would increase the flash rate.) Segment 124 is connected to pin 4 by lead 132. Segment 122 (not shown) is connected to pin 6 by lead 134 and segment 120 is connected to pin 5 by lead 136. Capacitor 114 is connected between pins 2 and 8 by leads 138 and 140. Pin 5 connects with the positive side of battery 142 through lead 144 and positive contact 126 at the bottom of the insert 104. Pin 4 connects with the negative side of battery 142 through lead 146 to a solder bead 148 on insert 104 which makes contact with brass cylinder 108 and brass grommet 106 of brass cup 102. Battery leads 150, 152 (see FIG. 5) are internal connectors of the flashlight housing the battery 142 and the bulb module 100.

The entire insert assembly 104 is potted in epoxy and is formed slightly smaller than the interior of the brass cup 102. With handle 128 it can be rotated so that the LED operates in the desired mode, with a red or green blinking or steady light.

Rotation of handle 128 in 90 degree increments causes different opposed pairs of segments 118, 120, 122, 124 to contact LED leads 114, 116, thus altering the electrical configuration of the circuit. FIG. 5 is a schematic diagram of the circuitry involved with the bulb in FIG. 4 showing the circuitry of the insert 104 inclosed within the dashed lines 105. Assuming lead 116 from the Tri-Color LED 110 is the cathode or negative lead, a steady green light will be produced with the insert positioned as shown in FIG. 5. In this position, the cathode lead 116 is directly connected to the negative battery contact 152 through segment 124, wire leads 132, 146, solder bead 148 and brass cup 102. The anode lead 114 of Tri-Color LED 110 is connected directly to the positive battery contact 150 through segment 120, wire leads 136, 144, and positive contact 126 to complete the circuit. In this manner the flashing circuitry is completely bypassed, thus producing steady green light. It can be seen that rotation of the insert 180 degrees will change the polarity of the current supplied to Tri-Color LED 110, thereby producing a steady red light. In other words, upon rotation of the insert 180 degrees, segment 120 will contact LED cathode lead 116 connecting it to the positive battery lead 150 as previously described and segment 124 will contact LED anode lead 114, connecting it to the negative battery lead 152 as previously described. The internal circuitry of the Tri-Color LED 110 senses the polarity change and automatically displays the red color. Since the flasher circuitry is still being bypassed, a steady red color is displayed.

If it is desired to obtain the flashing mode, it is necessary to rotate the insert 104, by means of handle 128, 90 degrees from the position shown in FIG. 5. If the insert is rotated 90 degrees counterclockwise a flashing green light will be displayed. In this case, Tri-Color LED lead 116 will contact segment 118 which is connected to pin 8 of IC LM3909 and LED lead 114 will contact segment 122 which is connected to pin 6 of the IC. In this position the circuit matches that described for the bulb 72 in FIG. 3 except the cathode LED lead is connected to pin 8 rather than pin 1 of the IC 3909. As previously explained, pins 1 and 8 of the IC can be used interchangeably to vary the flash rate of the LED.

It should now be apparent that rotation of insert 104 90 degrees in a clockwise direction from the position shown in FIG. 5 would cause a red flashing light to be displayed. In this situation LED lead 116 will contact segment 122 connecting it to pin 6 of the IC and LED lead 114 will contact segment 118 connecting it to pin 8 of the IC. Again the Tri-Color LED 110 will sense the polarity reversal and since the flashing circuitry is now included in the circuit, a flashing red light will be displayed.

Figure 6:
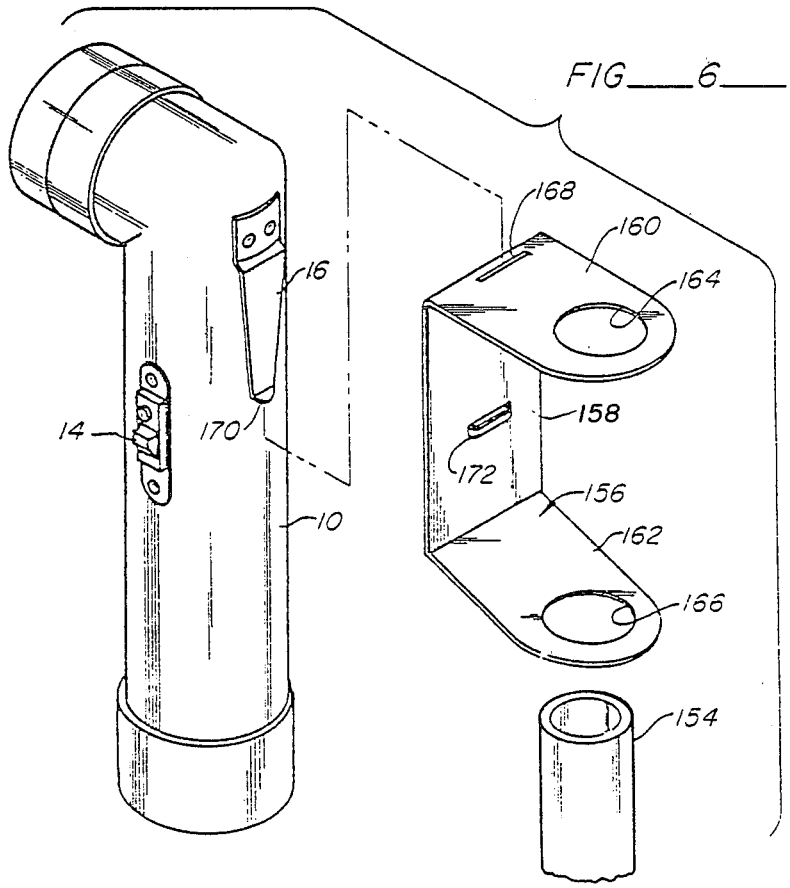
FIG. 6 is an exploded view in perspective of the flashlight mounted on an aiming post.

FIG. 6 is an exploded view in perspective of the flashlight mounted on an aiming post. As pointed out in describing the flashlight 10 in FIG. 1, the flashlight itself is unmodified. If no bulbs of the type described are available, an ordinary flashlight bulb, such as a PR6 bulb for example, may be used. The aiming post 154 is driven into the ground. Preferably, it is an ordinary tubular length of pipe. A spring steel bracket 156 is adapted for mounting on post 154 with flashlight 10 attached to the bracket 156 by means of the flashlight belt clip 16.

Bracket 156 is a flat thin strip of spring steel bent into a C-configuration with a vertical center portion 158, a horizontal upper portion 160 and a downwardly and rearwardly extending lower portion 162 sloping on the order of 110°. Upper portion 160 and lower portion 162 have openings 164, 166 for insertion over post 154, when the lower portion 162 is pressed to horizontal position. After insertion, the spring action of the bracket 156 tends to restore lower portion 162 to its 110° incline, frictionally clamping the bracket 156 to the post 154.

Upper bracket portion 160 has a slot 168 along its forward edge, into which the free end 170 of belt clip 16 may be inserted. The vertical center portion 158 has a transverse holding strip 172, depressed outwardly from its vertical plane, to receive the free end 170 of the belt clip 16 between the strip 172 and the central portion 158 of the bracket.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A multi-option LED module light bulb comprising an electrically conductive cup and a rotatable insert positioned therein, an LED positioned on said cup with leads extending therein and into contact with the top of said insert, said top of said insert being divided into a plurality of conductive segments whereby said leads contact selected segments, said insert having an integrated circuit and capacitor embedded therein, said circuit being connected to a center contact on the bottom of said base, said circuit and said capacitor being connected to said segments whereby said LED is energized by those segments contacting said LED leads, and means for rotating said insert to select segments for contact with said leads.

2. A multi-option LED module light bulb as set forth in claim 1 wherein said leads contact opposing segments.

3. A multi-option LED module light bulb as set forth in claim 1 wherein said means for rotating said insert is on said insert.

4. The method of making an LED light source having a base configuration similar to that of an ordinary flashlight bulb, said method comprising:

a. inserting the LED into a plastic grommet, b. extending and bending the anode lead of said LED to engage the base end, c. bending the cathode lead of said anode around said plastic grommet, d. inserting said plastic grommet and LED into a metallic grommet with said cathode lead positioned between said grommets, e. placing a cylindrical mold around said metallic grommet and leads and filling some with a non-conductive plastic such as epoxy, f. when set, removing said mold, and g. exposing said anode lead at said base end.

* * * * *